US007322299B2

(12) United States Patent
Greene

(10) Patent No.: US 7,322,299 B2
(45) Date of Patent: Jan. 29, 2008

(54) INTERLOCKING MODULAR TUBULAR PALLET

(76) Inventor: Joseph P. Greene, 2671 Lakewest Dr., Chico, CA (US) 95928

( * ) Notice: Subject to any disclaimer, the term of this patent is extended or adjusted under 35 U.S.C. 154(b) by 0 days.

(21) Appl. No.: 10/993,836

(22) Filed: Nov. 18, 2004

(65) Prior Publication Data

US 2005/0160949 A1 Jul. 28, 2005

(51) Int. Cl.
*B65D 19/12* (2006.01)

(52) U.S. Cl. ..... 108/56.1; 108/51.3; 108/64

(58) Field of Classification Search ..... 108/56.1, 108/56.3, 51.11, 57.25, 57.26, 901, 902, 153.1, 108/157.18, 150.12, 158.13, 64, 180
See application file for complete search history.

(56) References Cited

U.S. PATENT DOCUMENTS 4,243,279 A * 1/1981 Ackeret ..... 108/64
5,579,701 A * 12/1996 Fook Wah ..... 108/56.1
5,582,113 A * 12/1996 Langenbeck ..... 108/57.26
5,775,046 A * 7/1998 Fanger et al. ..... 108/64
5,809,902 A 9/1998 Zetterberg
5,809,905 A * 9/1998 John et al. ..... 108/56.1
5,896,818 A * 4/1999 Phillips ..... 108/51.11
5,921,189 A 7/1999 Estepp
6,216,608 B1 * 4/2001 Woods et al. ..... 108/57.25
6,234,087 B1 * 5/2001 Brown ..... 108/56.1
6,263,807 B1 * 7/2001 Fox et al. ..... 108/57.25
6,490,836 B1 * 12/2002 Moriau et al. ..... 52/589.1
6,510,665 B2 * 1/2003 Pervan ..... 52/589.1
7,107,913 B2 * 9/2006 Smith ..... 108/64

* cited by examiner

*Primary Examiner*—José V. Chen
(74) *Attorney, Agent, or Firm*—Bullivant Houser Bailey PC

(57) ABSTRACT

A modular section for forming a support structure, the section being elongated and having a generally annular cross-sectional configuration with spaced upper and lower surfaces and spaced side walls, the upper and lower surfaces and side walls forming upper and lower edges, respectively, at the interfaces, wherein the upper and lower surfaces each comprise an extension at the respective upper and lower edges, the extensions having a flange formed at the ends thereof, and where the upper and lower surfaces each have a groove formed therein.

23 Claims, 7 Drawing Sheets

800

300

500

INTERLOCKING MODULAR TUBULAR PALLET

CROSS REFERENCE TO RELATED APPLICATIONS

This application claims the benefit of U.S. patent application Ser. No. 10/397,703, filed Mar. 26, 2003, entitled "Interlocking modular tubular pallet" and U.S. Provisional Patent Application No. 60/366,033, filed Mar. 28, 2002, entitled "Interlocking modular polymer tubular design".

BACKGROUND OF THE INVENTION

1. Field of the Invention

The present invention relates to support structures, such as decking produced from plastic lumber materials, or pallets, for instance pallets on which articles are stacked or assembled to enable handling and shipment of articles. More specifically, the present invention relates to support structures that can be easily assembled in modular fashion in several configurations to provide continuous top and bottom surfaces, and at a minimal expense, and that can be easily assembled, disassembled and reassembled as needed for maintenance.

2. Description of Related Art

Historically, pallets have been constructed with wood materials, having a plurality of parallel stringers on which are nailed or otherwise secured one or more structural members defining a platform. Pallets and decking have also been constructed of extruded or formed metal such as steel or aluminum, and also been molded or extruded plastic materials, including virgin plastic material or plastic material that has been recycled or reclaimed from waste. The materials used in said pallets and said decking are typically connected using mechanical fasteners or bonding agents.

Support structures of this type that are constructed of plastic have unique problems. For decking applications, the existing solid plastic lumber is heavier than the conventional wood deck and requires nails, fasteners, or adhesives to hold it together. Most pallet designs do not have interlocking sections and as such require fasteners.

Current designs for pallets utilizes fasteners to build structure into the pallet. The U.S. Air Force uses a balsa-wood pallet with aluminum skin to transport cargo in the cargo planes. The aluminum skin is attached to the balsa wood core material with adhesives and rivets. This design causes the pallet to be heavy and also requires the pallet to be repaired at the manufacturing facility in Minnesota. There is a need, then, for a pallet that is lighter, less expensive, and easier to repair than the current balsa wood pallet.

For wood decking applications, the wood and most plastic lumber materials are solid and are attached with nails into cross beams. Bending stresses in such a decking application occur on the top and bottom surfaces, but the solid material is used is very heavy.

Prior patents in the area of pallets and decking offer sections that do not interlock simply, but rather require fasteners or other connecting structures or devices. In such prior designs it is difficult to create and maintain a continuous surface across the top or bottom of the structure, as the structural elements used in such pallets or decking are connected with mechanical fasteners or bonding agents.

Prior art structures include U.S. Pat. No. 5,921,189, to Estepp, for a pallet made from a rectangular tubular elements of open ended plastic material in adjacent parallel contact, which and are fastened at outer sidewalls and at the ends by a fastening device.

U.S. Pat. No. 5,809,902, to Zetterberg, describes a pallet comprised of a solid deck comprised of rail elements that are attached together with at least two elongated, angularly folded fixing members that attach with insertable grooves made in the boards transverse to their longitudinal direction. The fixing member is made of metal as an angle piece with flanges. The grooves and fixing member engage on top surface and on perpendicular side face. The grooves are cut into deck material perpendicular to longitudinal direction In Zetterberg the fasteners are required to secure the separate sections. The separate sections are connected with a modified angle iron that engages only at the ends of the rail elements. The middle sections of adjacent rails are not connected or secured to one another for support.

In some prior devices the side walls and not the top and bottom walls have an interlocking structure. A side-wall connecting pallet requires fasteners and/or adhesives to hold the structure together. The side-connecting plane results in a shearing plane being formed when weight is added to the top surface. The weight in loaded on the top surface, which is perpendicular to the side-interlocking surface. This is the cause of the shearing plane. The shearing plane is on the side walls and will result in the side walls separating as the weight on the top surface causes the pallet to bend. Thus the side walls still must be attached via mechanical fasteners and/or bonding agents. Current designs for pallets and decks utilize adhesives or fasteners to build structure.

No pallet or decking of the prior art provides sections that interlock and form a continuous surface on top or bottom. Thus there remains a need for a modular support structure that does not require special fasteners or bonding agents.

SUMMARY OF THE INVENTION

The present invention provides a tubular structure with a snap fit of interlocking sections that form a surface in the same plane as the weight on the top surface that would further engage the interlock connection With the invention, there is provided a modular pallet that can be easily disassembled and reassembled to connect other tubular sections, if a repair is required. It provides a pallet or decking product that is lighter, less expensive, and easier to install than current solid plastic lumber, and lighter, less expensive, and similar in cost to wood products.

The interlocking structure uses a modular structure with overlapping annular, or tubular, sections. Thus, there is provided a modular section for forming a support structure, being elongated and having a generally annular, or open, cross-sectional configuration with spaced upper and lower surfaces and spaced side walls, the upper and lower surfaces and side walls forming upper and lower edges, respectively, at the interfaces, wherein the upper and lower surfaces each comprise an extension at the respective upper and lower edges, the extensions having a flange formed at the ends thereof, and where the upper and lower surfaces each have a groove formed therein.

When two adjacent sections are aligned along respective side walls the flange of an upper surface extension fits the groove in the upper surface of its adjacent section and the flange of a lower surface extension occupies the groove in the lower surface of a neighboring section, thereby forming an interlocking fit of the adjacent sections. Preferably, the upper and lower surfaces of each adjacent modular section are disposed in substantially parallel relation with each other, and the side walls are disposed in substantially parallel relation with each other, and substantially perpendicular to the upper surface and the lower surface wall. In this way the upper surfaces of adjacent interlocking sections form a continuous planar surface for the support structure, as will the lower surfaces.

The modular sections may comprise at least one intermediate wall disposed between the side walls.

The modular sections are preferably integrally constructed, such as when formed by an extrusion process, though it may be formed by injection molding. A preferred such section is formed of polypropylene, and may have a recycled plastic content.

The groove in the upper surface of each modular section extends the length of respective upper and lower surfaces, and is formed in a portion of the upper and lower surfaces removed from the edges formed with the side walls.

The plurality of modular sections can be selected to form a flat surface, such as a pallet or deck, or may be configured to form a more complex article such as a a piece of furniture, a bench, a table or a chair.

A method for manufacture of a tubular pallet is also provided, comprising forming a plurality of modular sections each having a generally open cross-sectional configuration with spaced upper and lower surfaces and spaced side walls, the upper and lower surfaces and side walls forming upper and lower edges, respectively, at the interfaces, where the upper and lower surfaces each comprise an extension at at least one edge, the extension having a flange formed at the ends thereof, and where the upper and lower surfaces each have a groove formed therein; and establishing interlocking assembly of the interlocking sections for securing top and bottom walls of the plurality of pallet sections in interlocked assembly.

A tubular pallet is also provided comprising a plurality of elongated plastic modular sections having protruding flanges on the top surface and bottom surfaces of one side arranged to interlock with grooves formed in the top surface and bottom surface of the opposite side of an adjacent section. The flanges extends along the length of the tubular section and the grooves are formed such that a flange of one section is insertable into the corresponding groove formed in the adjacent section to secure one the adjacent sections. Each of the flanges has a depth and a width that substantially corresponds to a depth and width of the corresponding groove, though the groove may be wider that the width of the flange to allow for expansion.

In a preferred embodiment the flanges reversibly are removable from the grooves to allow easy disassembling of the pallet.

These and other features and advantages of this invention are described in, or are apparent from, the following detailed description of various exemplary embodiments of the devices and methods according to this invention.

BRIEF DESCRIPTION OF THE DRAWINGS

Various exemplary embodiments of this invention will be described in detail, with reference to the following figures, wherein.

DETAILED DESCRIPTION OF THE PREFERRED EMBODIMENT

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

Figure 1:
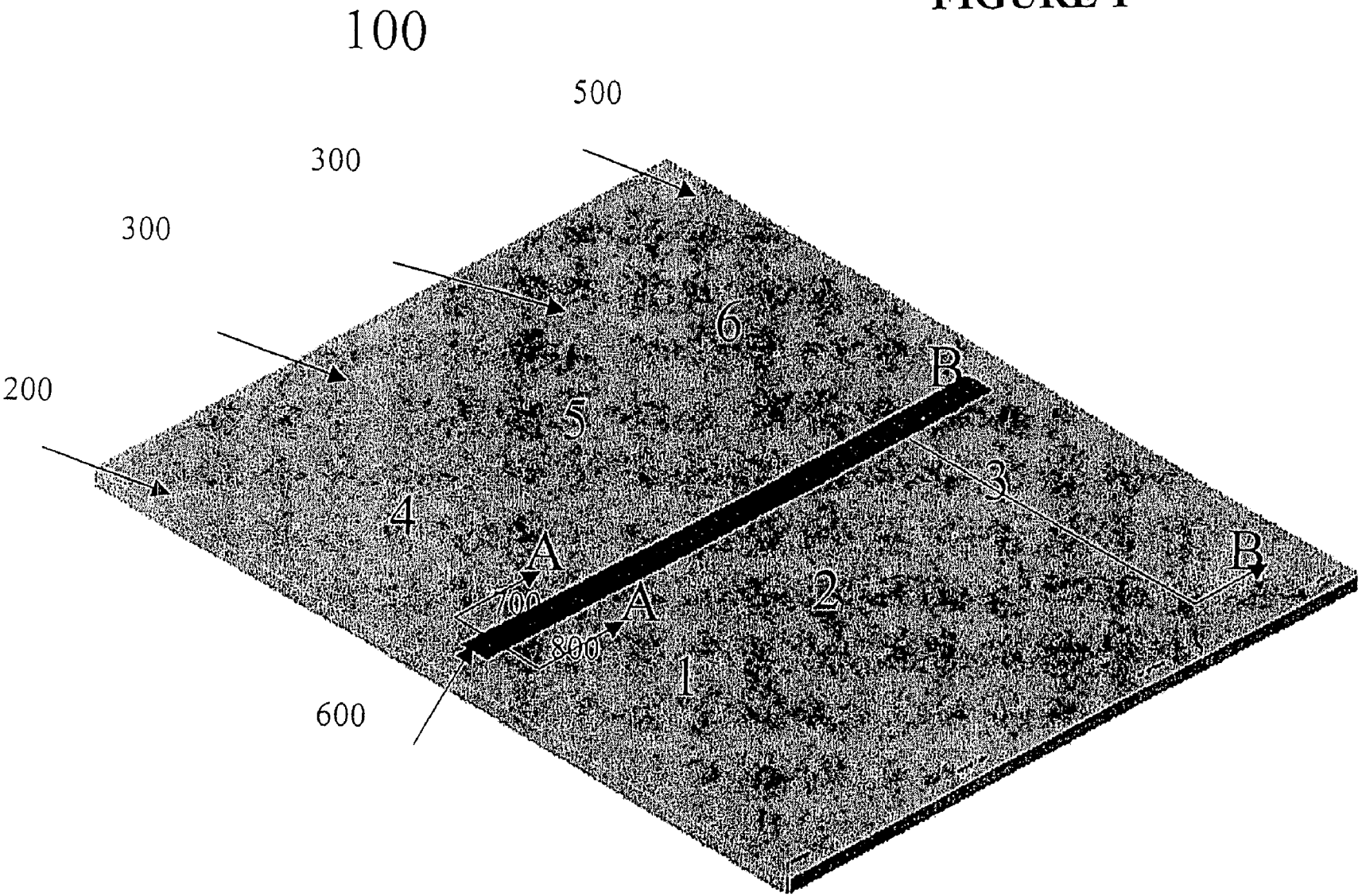
FIG. 1 is an isometric illustration of an assembled structure with six modular sections (1, 2, 3, 4, 5 and 6), end pieces, middle connecting pieces, and cross piece that is constructed in accordance with principles of the present invention.

Thus, as will be understood more clearly from the embodiment of the support structure, in accordance with the invention, and illustrated in FIG. 1, the support structure comprises tubular section members that interlock along the edges, as well as finish pieces that connect with the ends of the tubular sections. By "tubular" is meant that the section has an open, or annular, structure in cross section.

The support structure provides a continuous surfaces, top and bottom, without gaps, with large open or air spaces inside the structure based upon the annular profile section. Also, the support structure is made of sections that are interlocking and overlapping and snap together without fastening devices. A support structure, such as a pallet, produced from the tubular sections is lighter, less expensive, and easier to repair than current pallets made from balsa wood and aluminum skins.

Referring again to FIG. 1, a support structure in the form of a pallet in accordance with the principles of the present invention and representing the preferred embodiment is illustrated generally as 100. As seen in FIG. 1, the pallet 100 is formed of sections connected without fasteners, but which interlock along the top and bottom surfaces. It is not necessary to form such a structure that one provide fasteners at the weaker side walls or along the outermost perimeter.

In FIG. 1 the pallet is shown composed of six subassembly sections, or sections 1, 2, 3, 4, 5, and 6, which are interconnected and which define a pallet structure of integral construction. The interlocking structure is built based upon a modular structure with each subassembly section further comprising overlapping tubular sections. For each tubular section a protruding flange is interlocked into a corresponding groove in an adjacent section. The tubular sections are connected together in this fashion until the desired pallet section is created.

Figure 2:
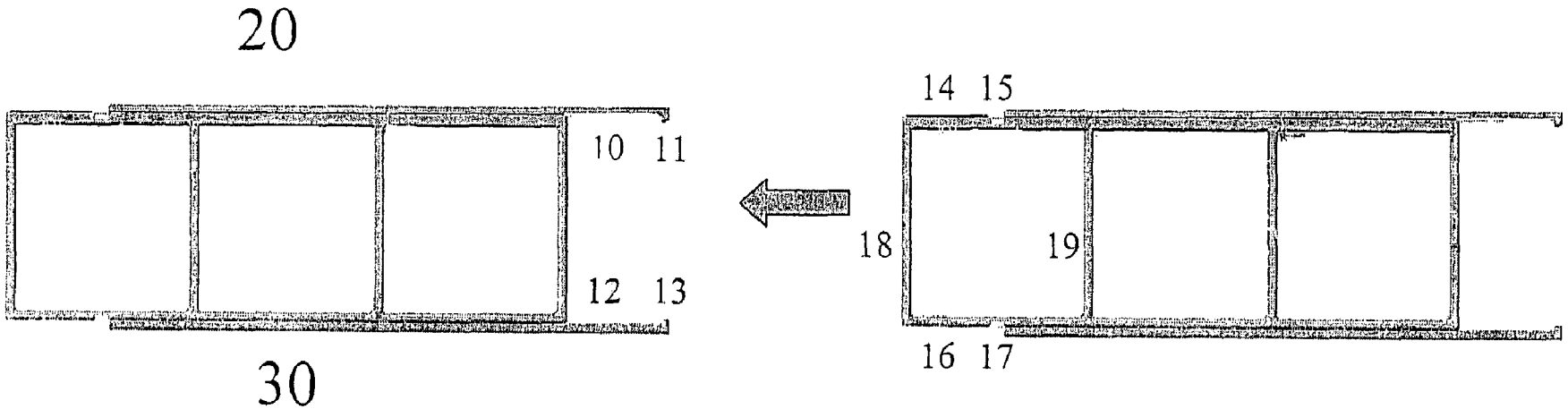
FIG. 2 is a fragmentary cross sectional view of the pallet construction showing an extruded single tube with three open channels and showing the interlocking tubular section.
Figure 3:
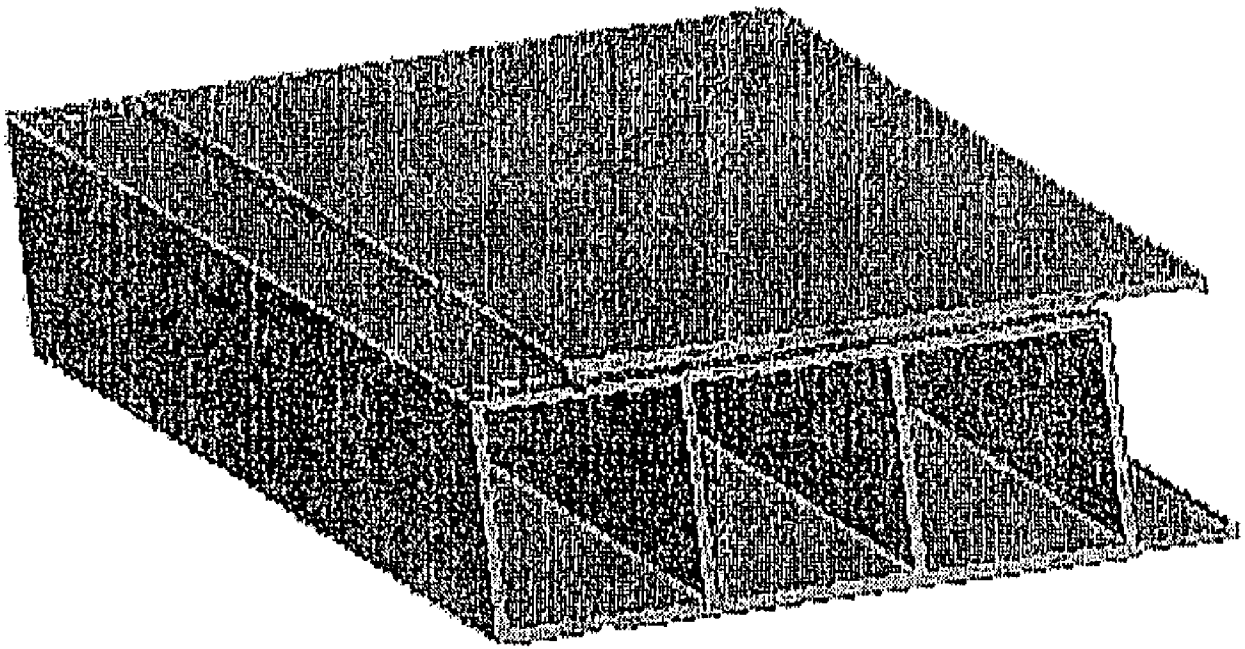
FIG. 3 is a fragmentary isometric illustration similar to that of FIG. 2 and showing an extruded single tube with three open channels.

Looking more particularly at pallet sections, FIGS. 2 and 3, they have top 20 and bottom 30 surfaces. The interlocking and overlapping sections provide a continuous surface.

The interlocking flange design allows for structural integrity, smooth rolling surface on top and bottom. At least two tubular elements are located next to one another with collinear edges and are oriented in the same direction to support loads on top and bottom surfaces and resist bending. Each tubular section of subassembly sections 1, 2, 3 4, 5 and 6, has a planar upper wall 10 defining an upwardly facing planar surface 20 and with a planar lower wall 12 defining a downwardly planar surface 30 is substantially coplanar with the upper wall of the neighboring tubular section with the same geometry and planar upper wall 14 defining an upwardly facing planar surface 20 and with a planar lower wall 16 defining a downwardly planar surface 30.

The edge of the top surface 10 of one tubular section has a flange 11 that protrudes from it and is of such a design that it fits in a corresponding groove 15 of an adjacent tubular section so as to provide a flat connected surface. The top walls 20 and 30 define flange and tab interlocking connectors for securing the pallet sections in immovable assembly. The protruding flanges 11 and 13 are on the top and bottom walls and on the right side with corresponding grooves 15 and 17 on the top and bottom walls and on the left side of the tubular section. The flange can as well be on the left side top and bottom walls with the corresponding groove on the right side top and bottom walls. Some tubular sections can have flanges on both top and bottom walls for the left and right sides. Some tubular sections can have grooves on both top and bottom walls for the left and right sides. Any combination of the flange and groove as fore mentioned to provide interlocking modular sections.

Section 1 in FIG. 1 has a configuration with the flanges on the right side of the section and with grooves on the left side of the section. Section 4 in FIG. 1 has flanges on the left side of the section and grooves on the right side of the section.

Numerous suitable methods are know for manufacturing the tubular sections having the open or annular characteristic. Looking to FIG. 2, it is seen that each section has a generally open cross-sectional configuration, preferably composed of plastic material and having spaced upper and lower walls and spaced side walls, with the upper and lower walls of each tubular interlocking sections forming top and bottom surfaces defining the flange of one section. The top and bottom surfaces also comprise a groove configured so that the flanges of the neighboring section have a depth and a width that substantially corresponds to a depth and width of the corresponding groove of an adjacent section, so that the protruding flanges are insertable into the corresponding groove formed along the adjacent section. When so disposed next to one another with collinear edges the sections are oriented in the same direction to support loads on top and bottom surfaces that resist bending. Further, the surface between the groove and the edge may taper slightly to allow an easier fit. It is a simple matter to establish interlocking assembly of the sections for securing top and bottom walls of said plurality of pallet sections in interlocked assembly. The flanges may form angles relative to the top horizontal surface, either at right angles or less angled to accommodate a taper. The right angle or tapered angle need only be sufficient to interlock in the groove in an adjoining tubular section.

The grooves may be wider that the width of the flange to account for expansion and contraction of plastic sections during weathering effects of hot and cold ambient temperatures.

Thus, it is seen that the individual sections have a shape that may be extruded with the interlocking features molded in the tubular structure. More particularly, the annular sections, FIGS. 2 and 3, can be made from processing methods, such as extrusion, stamping, machining, welding, etc. The annular sections, FIGS. 2 and 3, can be made from conventional plastic and polymer processing methods, such as extrusion, injection molding, reaction injection molding, resin transfer molding, compression molding, pultrusion, hand lay-up methods, and polymer foaming operations. Other polymer materials that incorporate the design include all thermoplastic and thermoset polymers, rubber polymers, foam polymers, wood filled polymers, organic and inorganic filled polymers organic and inorganic reinforced polymers, wood and metal materials, and other moldable and formable materials. Variations on the manufacturing method include all common thermoplastic and thermoset manufacturing processes, including, extrusion, injection molding, compression molding, Reaction Injection Molding (RIM), thermoforming, rotational molding, Resin Transfer Molding (RTM). The extruded annular section is extruded to the desired length. The extruded sections are then snapped together to form modular sections, e.g., sections 1, 2, 3, 4, 5, and 6, as shown in FIG. 1. The cross section can include one, two, three, or more hollow sections as determined by the forming die.

Figure 4:
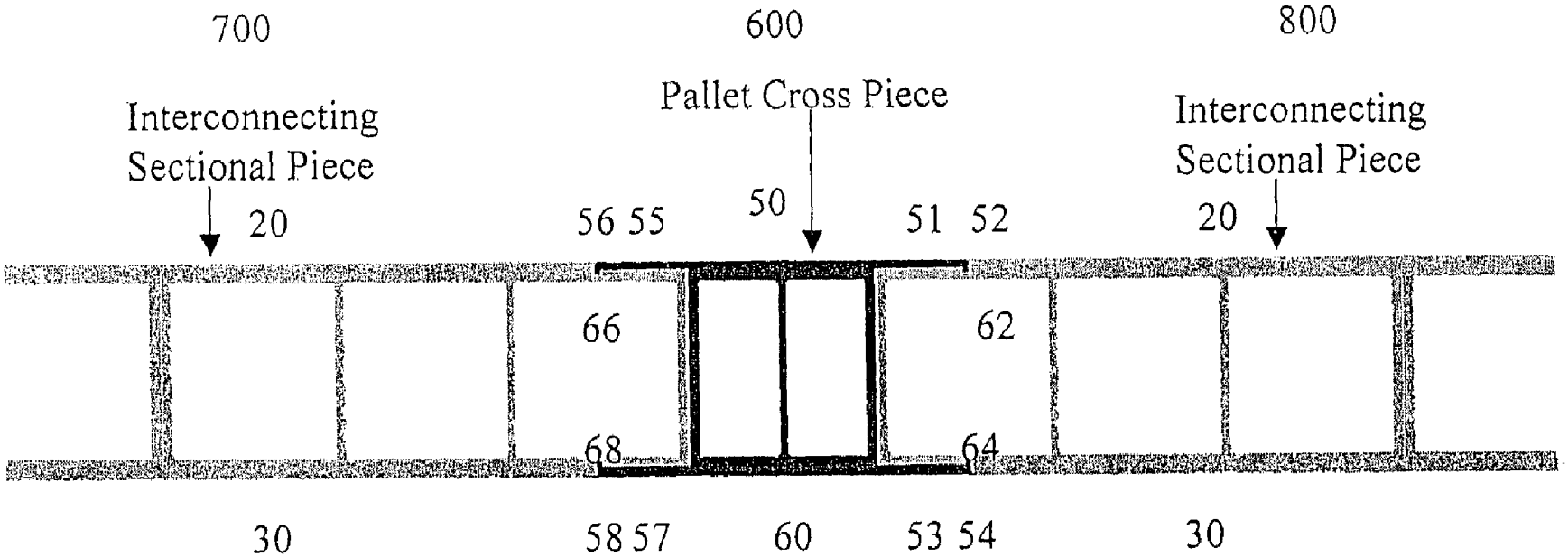
FIG. 4 is a fragmentary sectional view taken along section A-A as depicted in FIG. 1 and showing the interlocking features of the sections and the use of interconnecting cross piece.

The formed pallet subassembly sections can be joined together in the manner illustrated in FIG. 4, with a cross piece 600 that will join two sections that both have flanges or both have groove sections. The length of the tubular members are determine by cutting them to a particular length at the manufacturing operation. Cutting longer tubular members or connecting the ends of tubular members with connecting pieces, as illustrated in FIG. 1, can increase the lengths. The middle connecting piece 300 is a short piece of that snugly fits in the ends of the tubular members 880. It will fit in the ends much like a wooden dowel fits in the ends of straws to produce a very long straw structure. The length of the connecting piece depends upon the choice of how much engagement is desired between the pieces, where half of the connecting piece is in one tubular member and the other half is in the connected tubular member. Typical, lengths of the connecting piece can be 2 inches to 8 inches.

After establishing interlocking assembly of the interlocking sections, securing the interlocking sections in permanent and immovable assembly can be further assisted by the use of various additional pieces. FIG. 1 shows such a support structure in the form of a pallet of a plurality of modular tubular sections. As shown in FIG. 1, an example of a pallet structure utilizing the present invention can have six tubular sections that have a interlocking tubular section as described but not limited to FIG. 2 and FIG. 3 and are connected with pallet cross pieces as shown in FIG. 4.

The pallet cross piece 600 (FIG. 4) connects the edges of two adjoining pallet sections that have a flange on one side and a groove on the opposite side as shown in but not limited to FIGS. 2 and 3. The interlocking tubular sections, e.g., sections 1, 2, 3, 4, 5, and 6 in FIG. 1, may also be connected on the annular end with middle connecting piece 300 and 400 as shown in FIG. 1.

Figure 6:
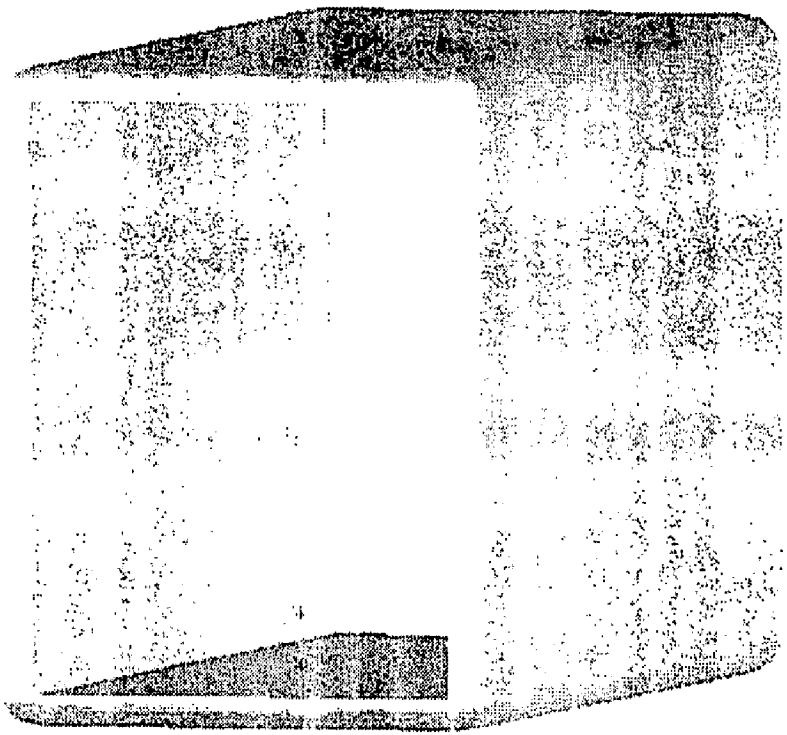
FIG. 6 shows a middle connector piece for an assembled pallet, for connecting the open longitudinal ends of tubular sections.

The modular sections can be made from 2, 3, 4, 5, or any number of sections, and additional pallet sections to be added to the ends of the tubular sections as well, with the use of middle connecting pieces 300, as shown in FIG. 6. The pallet is thus modular in both length and width, with no gap in the continuous surface, even at or near the attachment points.

Figure 7:
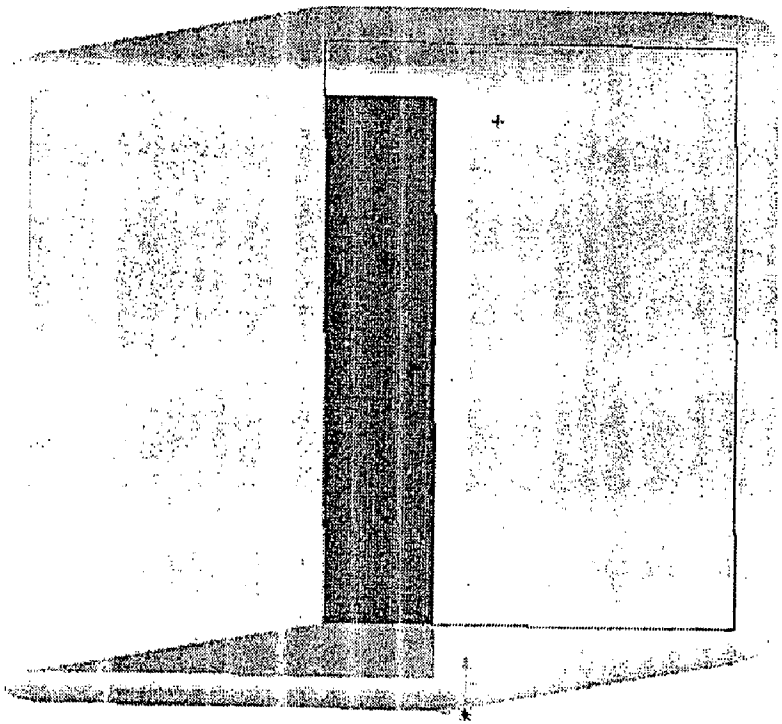
FIG. 7 shows an end piece used for closing open longitudinal ends of outside tubular sections of a pallet structure.

Also, the interlocking tubular sections, e.g., sections 1, 2, 3, 4, 5, and 6 in FIG. 1, may have end pieces 200 and 500 in FIG. 1 to close off the annular end of the tubular section and give the appearance of a solid section. The open ends of the tubular sections may not be desired as a product feature and so can be closed off with end pieces 500 in the manner illustrated in FIG. 1. The end piece 500, shown in FIG. 7, can act as an end cap for the tubular section so that tubular opening can be closed off and prevent foreign objects, rain, debris, rodents, or other items from collecting on the inside of the pallet. The end pieces are very similar in design as the connecting pieces 300 but have a truncated end.

When two subassembly sections come together at the center of the pallet, the sections cannot connect since both sections will have grooves butting together. As shown in FIG. 4, a pallet cross piece 600 connects the two groove sections since it has two flange regions on the left and right sides. It does not have a groove section as shown in fragmentary section view of FIG. 3, which shows interlocking geometry of rectangular cross-sectional configuration being employed to establish interlocking between pallet sections. The pallet sections interlock in a similar way as the flanges 52, 54, 56, 58 from the pallet cross piece lock in the grooves of the pallet sections 62, 64, 66, and 68.

In FIG. 4, the illustration depicts a left-handed flange with three hollow sections 700, a right-handed flange with three hollow sections 800, and a pallet cross piece 600. The right-handed flange with three hollow section profile 800 is repeated with similar sections many times to the right until section 1 is built. Similarly, the left-handed flange with three hollow section profile 700 is repeated with similar sections many times to the left until section 4 is built. Modular section 1 is connected with modular section 4 with the use of pallet cross piece 600. The pallet cross-piece can also be made with thicker wall sections to increase the rigidity of the cross section and provide a more rigid pallet. Similarly, a dual connector middle piece 300 is used to connect section 4 with section 5, as illustrated in FIG. 1. Sections 4 and 5 are connected with the tubular ends of the modular section.

The middle or dual connector piece 300 is also used to connect sections 1 to 2, sections 2 to 3, and sections 5 to 6. The modular design of the tubular sections allows for the continuous structure to be divided into several regions for ease of repair or serviceability. The modular sections are connected together with the snap fit assembly to form the overall structure shown as an example in FIG. 1.

With the interlocking modular sections the support structure, pallet, deck or other article, can be repaired less expensively and much easier than a single unit type of construction. If several modular sections are combined to make a structure, then if one section is damaged, it can be replaced by disconnecting the one bad section from the whole unit and replacing the bad section with a good section. The air sections formed by the annular nature of the tubes makes them substantially lighter than most conventional pallet and decking or related materials.

Although six pallet tubes or sections are shown, such is not intended to limit the spirit and scope of the present invention because any suitable number of interconnected tubes or sections may be utilized. Also, elements or sections in the form of structures other than tubular elements or sections may be also within the spirit and scope of the present invention. It is only necessary that the sections that are assembled to form a pallet structure integrity to support objects or articles of predetermined maximum weight and that the pallet be capable of being supported in a floor surface and that the pallet present a substantially planar upper surface on which articles may be stacked.

A pallet produced from the tubular sections would be lighter, less expensive, and easier to repair than current aircraft pallets made from balsa wood and aluminum skins. The continuous top surface provides a continuous support for loading along the edges will not result in a gap between the decks even if only supported at the ends.

Figure 5:
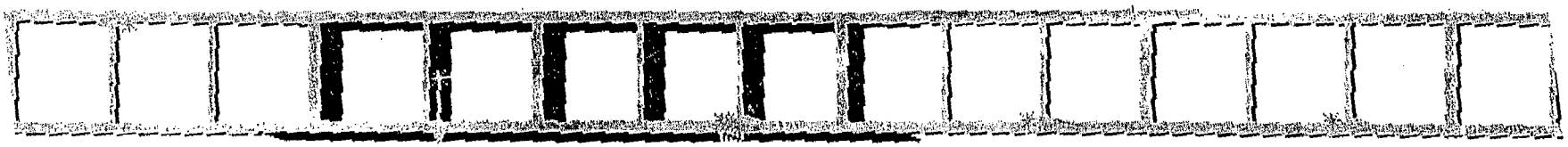
FIG. 5 is a fragmentary sectional view taken along section B-B as depicted in FIG. 1 and showing the interlocking tubular sections.

The modular sections can comprise two or more sections that snap in to one or several units. As an example, the pallet structure in FIG. 1 depicts 6 modular sections and cross pieces that are further illustrated in Section A-A (FIG. 4) and Section B-B (FIG. 5). Section A-A illustrates the use of the design for the thermoplastic material, though it also sufficiently describes the design for metallic, plastic, composite, or other polymer materials. Alternate versions of the invention include other designs with tabs that interlock, other manufacturing processes for polymer materials, and other polymer-based, organic-based, and metallic-based materials. Variations on the design include manners to snap-fit pieces of tubular sections to form a modular structure. This can include other flange designs on the end of the cross section and the mating tubular or solid sections. Additionally, if desired, the interlocking tubular sections of the top walls can be secured by adhesive, welding, bonding agent, or mechanical fasteners so that the resulting joint is of permanent and the pallet sections form an integral pallet unit. Also, the pallet section joint may be heat or chemically fused during assembly to prevent inadvertent separation of the pallet sections during use.

Sections 300 and 500 (FIGS. 6 and 7, respectively) are depicted as friction fit connectors. Section 300 is the middle connecting piece that connects the ends of two tubular sections. The tubular section may need several pieces of the 300 part depending on how many openings are in each end section as shown in FIG. 2 and for surfaces 20 and 30. Typically three connection sections are needed for each tubular sections. Similarly, several end pieces (200 and 500) may be needed to close out the section and make it look solid.

The benefits of the connecting pieces are to provide local structure for the pallet (or decking) and to enable it to be modular in the length direction. The number of connecting sections and the length between sections can vary depending upon the application. Some pallet (or decking) designs might require close spacing of the tubular sections, whereas, other designs might require very large spacing between sections. The thickness of the connecting pieces can also vary depending upon the application. The connecting pieces allows an increase in thickness at the connection and thus stiffening the section since it is thicker. The connecting pieces can be designed to accept fasteners or attachment devices for the pallet.

If a tubular section breaks, the connecting pieces allow the pallet to be disassembled and the damaged part replaced with a new section. The connecting pieces can be hollow or solid. The connecting pieces can be made from plastic, metal, wood, ceramic, rubber, polymer composite, or other suitable material. The repair and reassembly can occur at the end user's location, which will reduce the cost of repair and shipping.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A modular section for forming a support structure, said section being elongated and having a generally annular cross-sectional configuration with spaced upper and lower surfaces and spaced side walls, said upper surface meeting said side walls at upper edges, and said lower surface meeting said side walls at lower edges, wherein said upper and lower surfaces each comprise an extension of at least one edge, said extension having a flange formed at the ends thereof and wherein said upper and lower surfaces each have a groove formed therein.

2. The modular section of claim 1, wherein for two adjacent sections aligned along respective side walls the flange of an upper surface extension fits the groove in the upper surface of its adjacent section and the flange of a lower surface extension occupies the groove in the lower surface of a neighboring section forming an interlocking fit of said adjacent sections.

3. The modular section of claim 1, wherein said upper and lower surfaces are disposed in substantially parallel relation, and wherein said side walls are disposed in substantially parallel relation and substantially perpendicular to said upper surface and said lower surface wall.

4. The modular section of claim 1 further comprising at least one intermediate wall disposed between said side walls.

5. The modular section of claim 1, wherein said section is integrally constructed.

6. The modular section of claim 5, wherein said section is formed by an extrusion process.

7. The modular section of claim 5, wherein said section is formed by injection molding.

8. The modular section of claim 1, wherein said section is formed of polypropylene.

9. The modular section of claim 1, wherein said section has a recycled plastic content.

10. The modular section of claim 1, wherein said groove extends the length of respective upper and lower walls.

11. A support structure formed of a plurality of modular sections of claim 1.

12. The support structure of claim 11, wherein said support structures forms an article selected from the group consisting of a pallet, a deck, a piece of furniture, a bench, a table, and a chair.

13. The support structure of claim 11, wherein upper surfaces of adjacent interlocking sections form a continuous planar surface for said support structure.

14. The support structure of claim 11, wherein lower surfaces of adjacent interlocking sections form a continuous planar surface for said support structure.

15. A method for manufacture of a tubular pallet comprising forming a plurality of modular sections each having a generally open cross-sectional configuration with spaced upper and lower surfaces and spaced side walls said upper surface meeting said side walls at upper edges, and said lower surface meeting said side walls at lower edges, wherein said upper and lower surfaces each comprise an extension at at least one edge, said extension having a flange formed at the ends thereof, and wherein said upper and lower surfaces each have a groove formed therein; and establishing interlocking assembly of said interlocking sections for securing top and bottom walls of said plurality of pallet sections in interlocked assembly.

16. A pallet comprising:

(a) a plurality of tubular interlocking pallet sections each being of generally annular cross-sectional configuration and having spaced upper and lower walls and spaced side walls, said upper and lower walls of each of said tubular interlocking sections having respective upper and lower grooves extending the respective lengths of the upper and lower walls adjacent one side wall and having extensions at the opposite side wall forming a continuous planar surface with said upper and lower walls;

(b) wherein, said upper and lower planar extensions have respective opposed downward and upward facing protruding flanges; and (c) wherein when at least two tubular elements are located next to one another with collinear edges and are oriented in the same direction the downward and upward facing flanges of one section protrude and fit respectively within the upper and lower facing grooves of the neighboring section to support loads on top and bottom surfaces and resist bending.

17. The pallet of claim 16, further comprising:

(a) each of said pallet sections defining planar top and bottom walls and said spaced side walls having substantially parallel relation and being oriented substantially perpendicular with said planar top and bottom walls; and (b) said interlocking elements securing top and bottom walls of adjacent pallet sections in interlocked assembly and orienting said planar top walls of said pallet sections in substantially co-planar relation.

18. The pallet of claim 17, further comprising:

a) each of said tubular pallet sections being of integral construction and said top and bottom walls being of planar configuration and being disposed in substantially parallel relation, said spaced walls being disposed in substantially parallel relation and being oriented in substantially perpendicular relation with said planar top wall and said planar bottom wall;

(b) said top and bottom walls of adjacent pallet sections defining said interlocking elements; and (c) said interlocking sections securing top and bottom walls of adjacent pallet section in interlocked assembly and orienting said planar top walls of each of said pallet sections in substantially co-planar relation and orienting said planar bottom walls of each said pallet sections in substantially co-planar relation.

19. A method for manufacture of a pallet comprising forming the plurality of tubular interlocking pallet sections of claim 16 and establishing interlocking assembly of said interlocking sections for securing top and bottom walls of said plurality of pallet sections in interlocked assembly.

20. The method of claim 19, further comprising, after establishing interlocking assembly of said interlocking sections, securing said interlocking sections in permanent and immovable assembly.

21. The method of claim 20, further comprising, adhesive bonding of said interlocking sections.

22. The method of claim 20, further comprising, thermal welding of said interlocking sections.

23. The method of claim 20, further comprising, mechanically fastening of said interlocking sections.

* * * * *